US009429049B2

(12) United States Patent
Mehta et al.

(10) Patent No.: US 9,429,049 B2
(45) Date of Patent: Aug. 30, 2016

(54) INTAKE VALVE ACTUATION SYSTEM FOR DUAL FUEL ENGINE

(71) Applicant: Caterpillar Inc., Peoria, IL (US)

(72) Inventors: Bhavin N. Mehta, Chennai (IN); John S. Pipis, Jr., Washington, IL (US); Anand Krishnaswamy, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/709,463

(22) Filed: May 11, 2015

(65) Prior Publication Data

US 2015/0240669 A1 Aug. 27, 2015

(51) Int. Cl.
*F01L 1/18* (2006.01)
*F01L 1/053* (2006.01)

(52) U.S. Cl.
CPC . *F01L 1/18* (2013.01); *F01L 1/053* (2013.01)

(58) Field of Classification Search
CPC ..... F01L 1/18; F01L 1/053
USPC ..... 123/90.25, 90.39, 90.44
See application file for complete search history.

(56) References Cited

U.S. PATENT DOCUMENTS

| | | | | |
|---|---|---|---|---|
| 5,165,375 | A | 11/1992 | Hu | |
| 5,195,489 | A | 3/1993 | Reich | |
| 5,479,896 | A | 1/1996 | Freiburg et al. | |
| 6,213,091 | B1 | 4/2001 | Haugen | |
| 6,394,050 | B1 | 5/2002 | McCarthy et al. | |
| 8,578,901 | B2 | 11/2013 | Ruggiero et al. | |
| 8,915,225 | B2 * | 12/2014 | Zurface | F01L 1/18 123/90.39 |
| 2014/0238015 | A1 | 8/2014 | Roberts et al. | |

* cited by examiner

*Primary Examiner* — Ching Chang

(57) ABSTRACT

An intake valve actuation (IVA) system for a dual fuel engine is disclosed. The IVA system is retrofittable between the dual fuel engine and a diesel fuel engine and includes a cam lobe with a cam-profile, a rocker arm, and an IVA piston. The rocker arm has a pad surface, which includes a plane that passes through a central axis of a rocker shaft. The rocker arm is operably connected with the cam lobe and intake valves. A rotational movement of the cam lobe corresponds to switch between the open and closed positions of intake valves. The IVA piston has a face portion, which selectively abuts against the pad surface, to temporarily lock the intake valves in open position. The IVA system defines a hand-off when the face portion abuts against the pad surface. The cam-profile facilitates constant velocity of the intake valves at the hand-off.

1 Claim, 6 Drawing Sheets

INTAKE VALVE ACTUATION SYSTEM FOR DUAL FUEL ENGINE

TECHNICAL FIELD

The present disclosure relates generally to intake valve actuation (IVA) systems for dual fuel engines. More specifically, the present disclosure relates to an IVA system that is retrofittable between a dual fuel engine and a diesel fuel engine.

BACKGROUND

Diesel fuel engines are known to employ an intake valve actuation (IVA) system to actuate intake valves of the diesel fuel engine. The IVA system works in conjunction with an assembly of a cam lobe and a rocker arm, to actuate and maintain the intake valve in an open position during an intake stroke and a portion of a compression stroke of the diesel fuel engine. More specifically, the assembly of the cam lobe and the rocker arm actuates and maintains the intake valve in the open position during the intake stroke of the diesel fuel engine. Thereafter, an IVA piston of the IVA system pushes against the rocker arm, to lock the intake valves in the open position during a portion of the compression stroke. Notably, the IVA piston applies a push force against the rocker arm, to lock the intake valves in the open position. This push force on the rocker arm applies a reverse side force on the IVA piston, which may lead to component failure of the IVA piston. This reduces a service life of the IVA system.

Moreover, a hand-off is defined by the IVA system when the IVA piston pushes against the rocker arm of the IVA system. During a conventional hand-off between the cam lobe and the IVA piston, jerk motion is generally observed on the intake valves. This jerk motion may cause failure of various components of the IVA system, such as but not limited to, the intake valves, the IVA piston and/or the rocker arm. This leads to failure of the IVA system to actuate the intake valves.

Conventionally known IVA systems installed in the diesel fuel engine may be incompatible with dual fuel engines. A number of design changes may be required in both the conventional IVA system and the dual fuel engine, to install the conventional IVA systems on the dual fuel engine. This may be laborious and may increase the overall cost of the IVA system. In addition, once installed on the dual fuel engine, it may be cumbersome to re-install the IVA system on the dual fuel engine. Therefore, it is required that an IVA system be retrofitted between the diesel fuel engine and the dual fuel engine.

U.S. Pat. No. 5,479,896 discloses a compression release engine braking system (the IVA system) to transmit force and motion to open a valve of an internal combustion engine. Although, this reference discloses the compression release engine braking system to open the valve of the internal combustion engine, no reference provides the IVA system retrofittable between the dual fuel engine and the diesel fuel engine.

SUMMARY OF THE INVENTION

Various aspects of the present disclosure are directed towards an intake valve actuation (IVA) system for a dual fuel engine. The IVA system is retrofittable between the dual fuel engine and a diesel fuel engine. The dual fuel engine has at least one intake valve, a camshaft, and a rocker shaft. The rocker shaft has a central axis. The IVA system includes a cam lobe, a rocker arm, and an IVA piston. The cam lobe has a cam-profile. The rocker arm is rotatably mounted on the rocker shaft and has a pad surface. The pad surface includes a plane that passes through the central axis of the rocker shaft. The rocker arm is operably connected with the cam lobe and with the at least one intake valve. A rotational movement of the cam lobe corresponds to an oscillatory movement of the rocker arm, which correspondingly facilitates a switch between an open position and a closed position of the at least one intake valve. The IVA piston has a piston axis and a face portion. The face portion is arranged opposite to the pad surface of the rocker arm. The face portion selectively abuts and pushes against the pad surface, to restrict the oscillatory movement of the rocker arm and at least temporarily lock the at least one intake valve in the open position. Moreover, the IVA system defines a hand-off when the face portion of the IVA piston abuts against the pad surface of the rocker arm. In addition, the cam-profile facilitates a constant velocity of the at least one intake valve at the hand-off of the IVA system.

DETAILED DESCRIPTION

Figure 1:
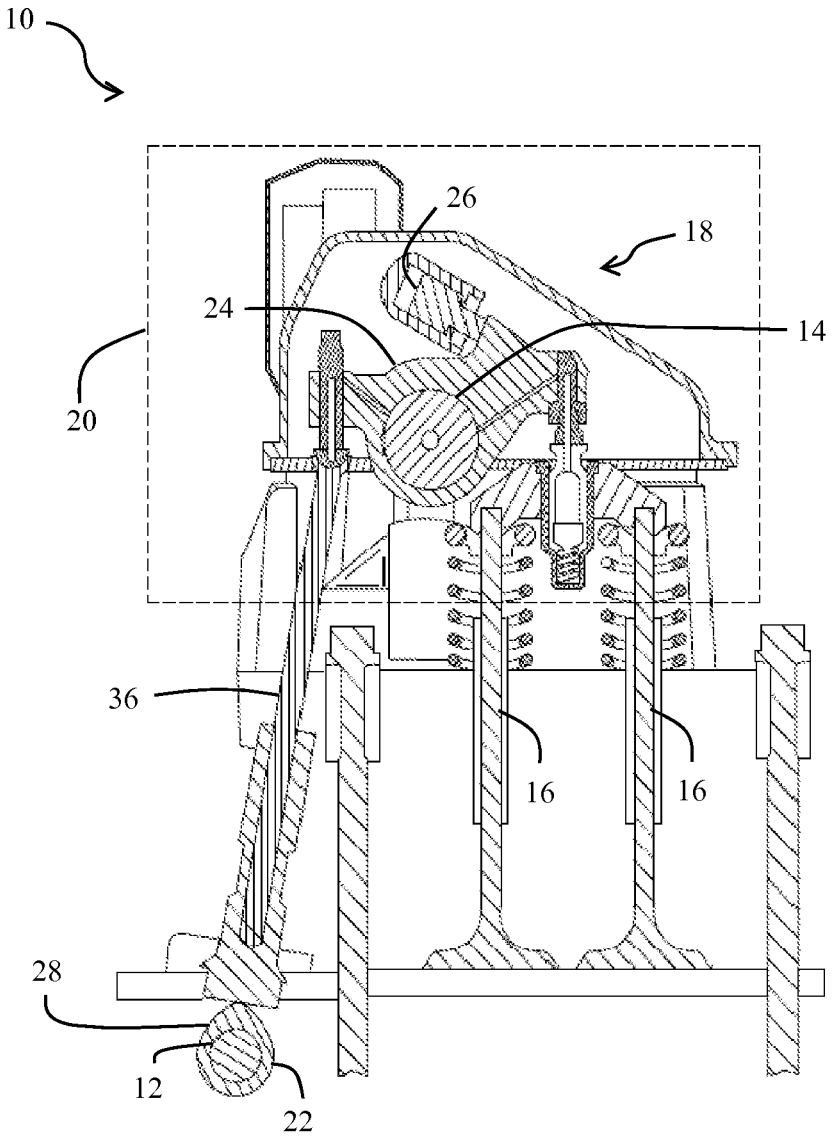
FIG. 1 is a cross-sectional view of a portion of a dual fuel engine that illustrates intake valves and an intake valve actuation (IVA) system for the dual fuel engine, in accordance with the concepts of the present disclosure.

Referring to FIG. 1, there is shown a portion of a dual fuel engine 10 for a machine (not shown). The machine (not shown) may embody a construction machine, a forest machine, a marine machine, and/or similar machines. As is customarily known, two fuels (for example a gaseous fuel and a diesel fuel) are selectively fed in a combustion chamber (not shown) of the dual fuel engine 10, to produce power required to run the machine (not shown). In an embodiment of the present disclosure, the dual fuel engine 10 is a four-stroke engine in which a piston (not shown) completes four strokes (an intake stroke, a compression stroke, a combustion stroke, and an exhaust stroke) in one complete thermodynamic cycle. Notably, four strokes of the dual fuel engine 10 are defined relative to an angular orientation (crank angle) of a crankshaft (not shown) of the dual fuel engine 10. Furthermore, the dual fuel engine 10 includes a camshaft 12, a rocker shaft 14, at least one intake valve 16, and an intake valve actuation (IVA) system 18. The IVA system 18 is adapted to actuate the intake valves 16 for crank angle corresponding to the intake stroke and at least a portion of the compression stroke of the dual fuel engine 10.

In an embodiment of the present disclosure, the intake valves 16 may be two tappet valves supported in a cylinder head (not shown) of the dual fuel engine 10. The intake valves 16 are adapted to operate in an open position and a closed position. In the open position, the intake valves 16 allow an air-fuel mixture to flow to the combustion chamber (not shown) of the dual fuel engine 10. In the closed position, the intake valves 16 restricts the flow of the air-fuel mixture to the combustion chamber (not shown) of the dual fuel engine 10. Although, the present disclosure contemplates tappet valves as the intake valve 16, various other types of intake valves 16 may also be contemplated.

Figure 2:
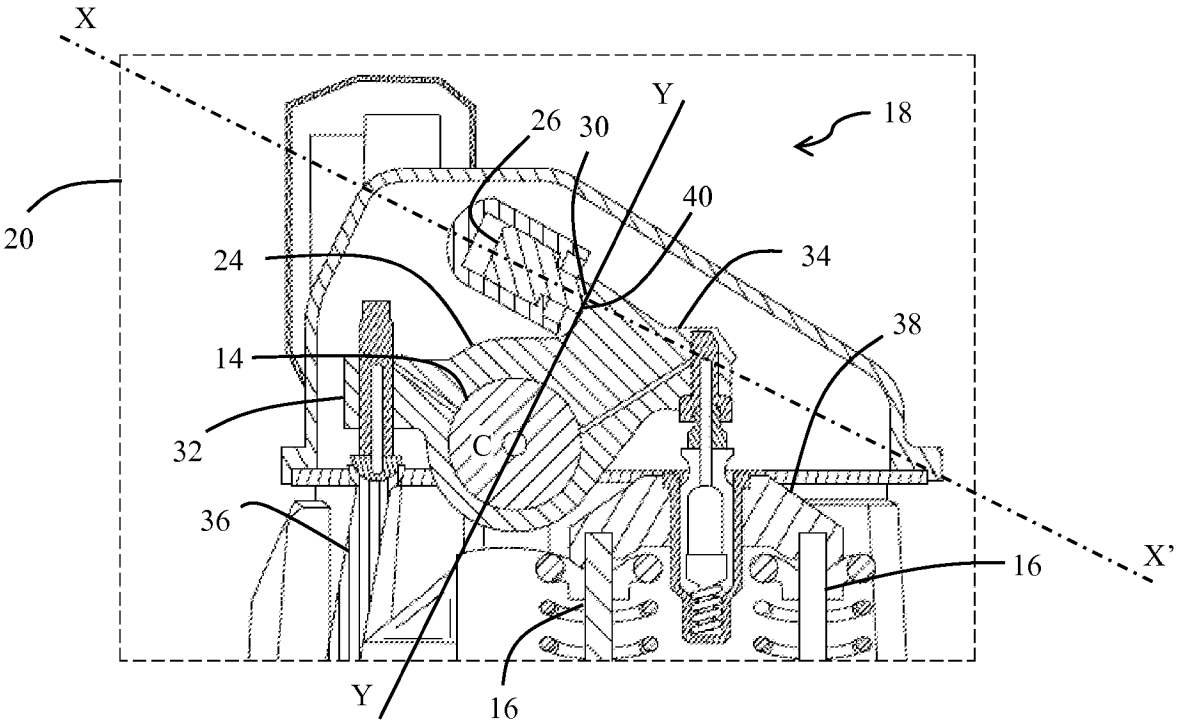
FIG. 2 is an enlarged view of a portion of the IVA system of FIG. 1, in accordance with the concepts of the present disclosure.

Referring to FIG. 2, there is shown a portion 20 of the dual fuel engine 10 that illustrates the IVA system 18 associated with the dual fuel engine 10. The IVA system 18 is adapted to switch the intake valves 16 from the closed position to the open position. Moreover, the IVA system 18 maintains the intake valves 16 in the open position for a range of crank angles corresponding to the intake stroke and a portion of the compression stroke. In an embodiment of the present disclosure, the IVA system 18 includes a cam lobe 22 (FIG. 1), a rocker arm 24, and an IVA piston 26. For clear understanding of the present disclosure, the cam lobe 22 is not shown in FIG. 2.

As is best seen in FIG. 1, the cam lobe 22 is fixedly mounted on the camshaft 12 and is adapted to rotate along with the camshaft 12. The cam lobe 22 includes a cam-profile 28, which is substantially oval shaped. The cam-profile 28 of the cam lobe 22 enables the opening and closing of the intake valves 16 via the rocker arm 24, when rotated by the camshaft 12.

The rocker arm 24 is rotatably mounted on the rocker shaft 14 of the dual fuel engine 10 and includes a pad surface 30, a cam attachment end 32, and a valve attachment end 34. The pad surface 30 of the rocker arm 24 is in a plane, Y that passes through a central axis C-C' of the rocker shaft 14. The cam attachment end 32 of the rocker arm 24 is connected to the cam lobe 22 of the IVA system 18 via the follower link 36. The valve attachment end 34 of the rocker arm 24 is connected to the intake valves 16 of the dual fuel engine 10 via a bridge member 38. Therefore, a rotational movement of the cam lobe 22 corresponds to an oscillatory movement of the rocker arm 24, which correspondingly facilitates a switch between the open position and the closed position of the intake valves 16.

Furthermore, it may be noted that the cam-profile 28 of the cam lobe 22 is structured, such that the cam lobe 22 maintains the intake valves 16 in the open position during the intake stroke. Once the intake stroke is completed, the cam lobe 22 attempts to switch the intake valves 16 to the closed position. However, for better operational efficiency of the dual fuel engine 10, the intake valves 16 are maintained in the open position for crank angles corresponding to a portion of the compression stroke, with use of the IVA piston 26.

The IVA piston 26 may be a hydraulic piston that includes a piston axis X-X' and a face portion 40. The IVA piston 26 is mounted on the cylinder head (not shown) of the dual fuel engine 10, such that the face portion 40 is arranged opposite to the pad surface 30 of the rocker arm 24. More specifically, the face portion 40 of the IVA piston 26 abuts against the pad surface 30 of the rocker arm 24. In this position, the piston axis X-X' is perpendicular to the pad surface 30 of the rocker arm 24. Further, the IVA piston 26 is adapted to selectively operate in a retracted position and an extended position. In the retracted position, the IVA piston 26 is inactive and the rocker arm 24 oscillates corresponding to the rotary movement of the cam lobe 22. In the extended position, the face portion 40 abuts and pushes against the pad surface 30, to restrict the oscillatory movement of the rocker arm 24 and at least temporarily lock the intake valves 16 in the open position.

Figure 3:
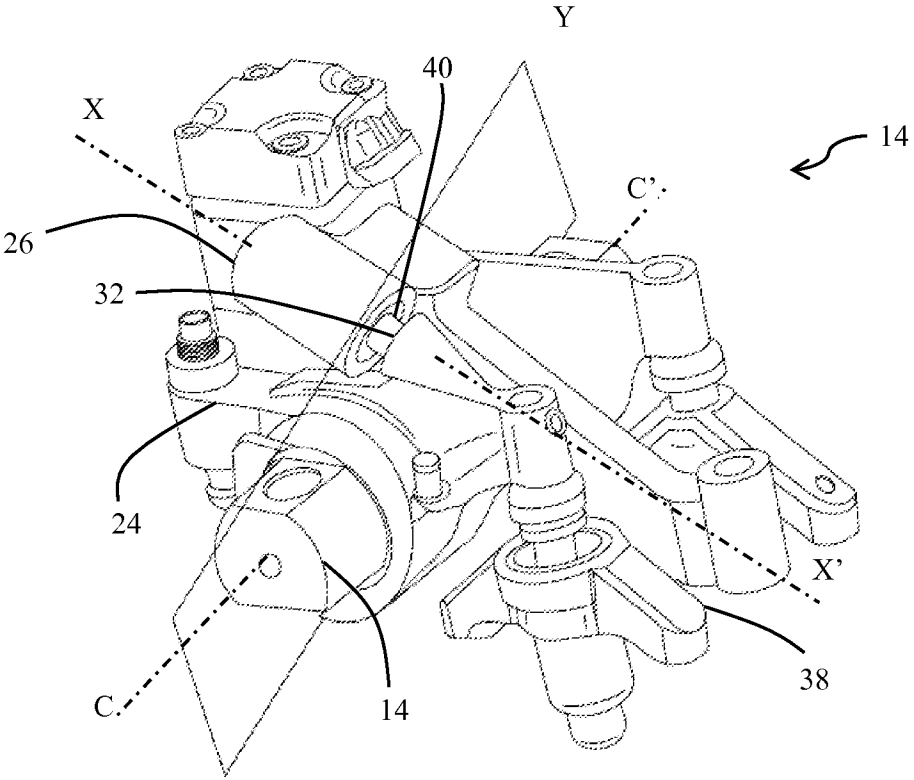
FIG. 3 is a perspective view of the IVA system of FIG. 1 and FIG. 2, in accordance with the concepts of the present disclosure.

Referring to FIG. 3, there is shown a perspective view of the IVA system 18 that better illustrates an arrangement of the IVA piston 26 with the rocker arm 24 of the IVA system 18. The IVA piston 26 may be hydraulically actuated, to switch from the retracted position to the extended position. The IVA system 18 defines a hand-off, when the IVA piston 26 switches from the retracted position to the extended position. The hand-off refers to an instance when a control of the intake valves 16 is transferred from the cam lobe 22 to the IVA piston 26. Although the present disclosure discloses the IVA piston 26, which is hydraulically actuated, it can be understood by a person skilled in the art that the IVA piston 26 can be actuated by any another means know in the art.

Figure 4:
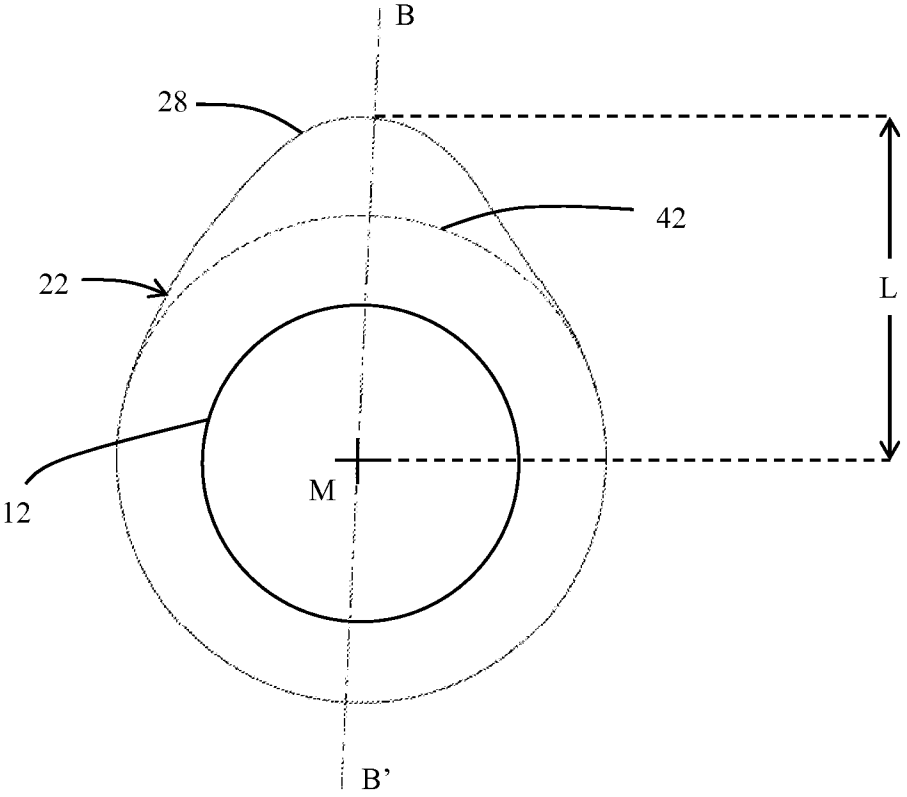
FIG. 4 is a side view of a cam lobe of the IVA system of FIG. 1 and FIG. 2 that illustrates a cam-profile of the cam lobe, in accordance with the concepts of the present disclosure.

Referring to FIG. 4, there is shown the cam lobe 22 of the IVA system 18. The cam lobe 22 includes the cam-profile 28 defined by a base circle 42, a maximum lift, L, and a cam axis B-B'. The cam lobe 22 rotates about a center, M of the base circle 42 and a cam side lift of the cam lobe 22 may vary as the cam lobe 22 rotates. Further, the cam lobe 22 includes the cam-profile 28 that facilitates opening and closing of the intake valves 16. It may be contemplated that a lift, a velocity, and an acceleration of the intake valves 16 during opening and closing of the intake valves 16 is dependent on the cam-profile 28 of the cam lobe 22. In an embodiment of the present disclosure, the cam-profile 28 is suitably structured, such that the cam-profile 28 facilitates constant velocity of the intake valves 16 at the hand-off of the IVA system 18. This eliminates acceleration and jerk motion of the intake valves 16 at the hand-off.

Referring to FIG. 5, FIG. 6, FIG. 7, and FIG. 8, there is shown a graphical representation of various cam side parameters (cam side lift, cam side velocity, cam side acceleration, and cam side jerk motion) of the intake valves 16 at different crank angles of the dual fuel engine 10. Notably, these cam side parameters (cam side lift, cam side velocity, cam side acceleration, and cam side jerk motion) correspond to actual parameters (lift, velocity, acceleration, and jerk motion) of the intake valves 16. More specifically, the lift, the velocity, the acceleration, and the jerk motion, respectively of the intake valves 16, is given by multiplication of the cam side lift, the cam side velocity, the cam side acceleration, and the cam side jerk motion with a rocker arm ratio. The IVA system 18 defines the hand-off when the face portion 40 of the IVA piston 26 abuts and pushes against the pad surface 30 of the rocker arm 24. As is already mentioned, the hand-off is an instance when the control of the intake valves 16 is transferred from the cam lobe 22 to the IVA piston 26. The hand-off initiates when the face portion 40 initially abuts against the pad surface 30 and ends when the control of the intake valves 16 is transferred to the IVA piston 26. It may be noted that the hand-off may occur in a range 44 of 543 degree crank angles to 546 degree crank angles. It can be further understood that the hand-off can vary depending on the compression ratio requirements and piston to valve clearance of the dual fuel engine 10.

Figure 5:
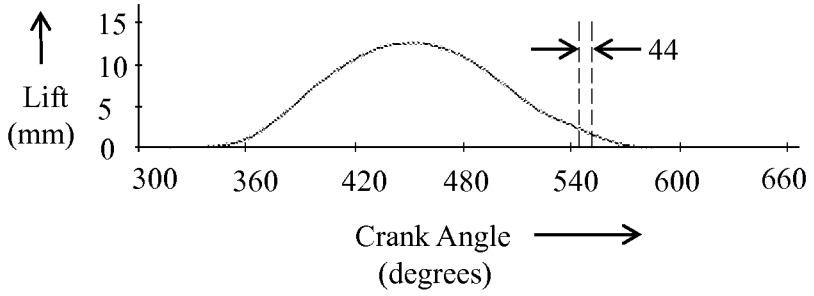
FIG. 5 is a graph between a cam side lift of the intake valves and a crank angle, in accordance with the concepts of the present disclosure.

Referring to FIG. 5, there is shown a graph that represents the cam side lift of the intake valve 16 relative to the crank angle of the dual fuel engine 10. The crank angle of the dual fuel engine 10 is depicted on the abscissa axis and the cam side lift of the intake valves 16 is depicted on the ordinate axis. Notably, the cam side lift of the intake valves 16 is a deviation of the cam lobe 22 relative to the base circle 42 of the cam lobe 22. The cam side lift of the intake valves 16 at 543 degree crank angles is 2.176 mm and at 546 degree crank angle is 2.311 mm. Moreover, the lift (actual) of the intake valves 16 is a displacement of a head of the intake valves 16 from a seated state in the closed position to an extended state in the open position. It may be contemplated that the lift (actual) of the intake valves 16 is given by multiplication of the cam side lift and the rocker arm ratio.

Figure 6:
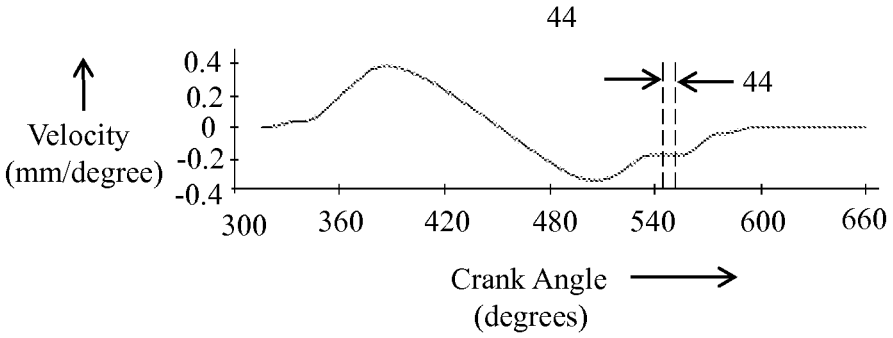
FIG. 6 is a graph between a cam side velocity of the intake valves and the crank angle, in accordance with the concepts of the present disclosure.

Referring to FIG. 6, there is shown a graph that represents the cam side velocity of the intake valves 16 relative to the crank angle of the dual fuel engine 10. The crank angle of the dual fuel engine 10 is depicted on the abscissa axis and the cam side velocity of the intake valves 16 is depicted on the ordinate axis. Notably, the cam side velocity is a first derivative of the cam side lift of the intake valves 16. The cam side velocity of the intake valves 16 at 543 degree crank angle is 0.19 mm/cam degree. The cam side velocity of the intake valves 16 at 546 degree crank angle is 0.19 mm/cam degree. Moreover, the velocity of the intake valves 16 is the actual velocity defined as change in the lift of the intake valves 16 for one degree rotation of the cam lobe 22. It may be contemplated that the velocity (actual) of the intake valves 16 is given by multiplication of the cam side velocity and the rocker arm ratio. Therefore, the cam side velocity and the velocity of the intake valves 16 are constant at the hand-off of the IVA system 18.

Figure 7:
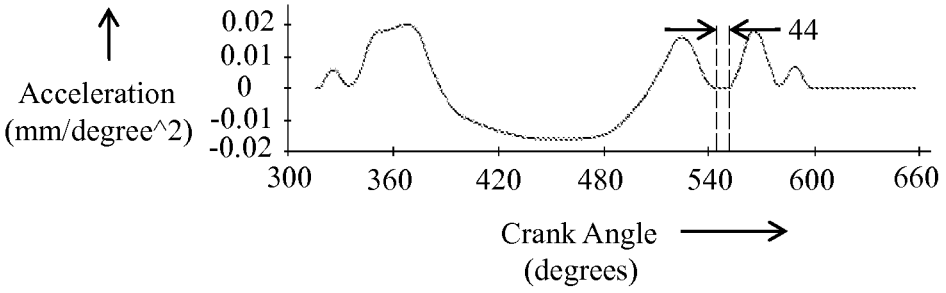
FIG. 7 is a graph between a cam side acceleration of the intake valves and the crank angle, in accordance with the concepts of the present disclosure.

Referring to FIG. 7, there is shown a graph that represents the cam side acceleration of the intake valves 16 relative to the crank angle of the dual fuel engine 10. The crank angle of the dual fuel engine 10 is depicted on the abscissa axis and the cam side acceleration of the intake valves 16 is depicted on the ordinate axis. Notably, the cam side acceleration is a first derivative of the cam side velocity of the intake valves 16. The cam side acceleration of the intake valves 16 at 543 degree crank angle is 0 mm/square cam degree. The cam side acceleration of the intake valves 16 at 546 degree crank angle is 0 mm/square cam degree. Moreover, the acceleration of the cam lobe 22 is defined as change in the velocity of the intake valves 16 for one degree rotation of the cam lobe 22. It may be contemplated that the acceleration (actual) of the intake valves 16 is given by multiplication of the cam side acceleration and the rocker arm ratio. Therefore, the cam side acceleration and the acceleration of the intake valves 16 at the hand-off is 0 mm/square cam degree.

Figure 8:
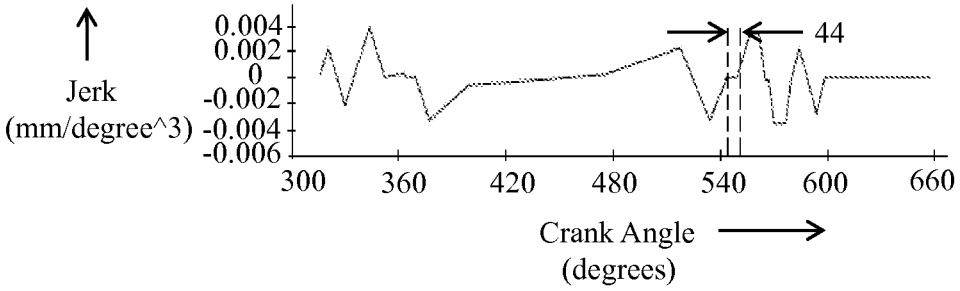
FIG. 8 is a graph between a cam side jerk motion of the intake valves and the crank angle, in accordance with the concepts of the present disclosure.

Referring to FIG. 8, there is shown a graph that represents the cam side jerk motion of the cam lobe 22 applied on the rocker arm 24 relative to the crank angle of the dual fuel engine 10. The crank angle of the dual fuel engine 10 is depicted on the abscissa axis and the cam side jerk motion of the intake valves 16 is depicted on the ordinate axis. Notably, the cam side jerk motion is a first derivative of the cam side acceleration of the intake valves 16. Similar to the cam side acceleration, the cam side jerk motion at 543 degrees crank angle and 546 degree crank angle is 0 mm/cubic cam degree. It may be contemplated that the jerk motion (actual) of the intake valves 16 is given by multiplication of the cam side jerk motion and the rocker arm ratio. Therefore, the cam side jerk motion and the jerk motion of the intake valves 16 at the hand-off is zero. This facilitates a smooth transfer of control of the intake valves 16 from the cam lobe 22 to the IVA piston 26.

INDUSTRIAL APPLICABILITY

In operation, the crankshaft (not shown) of the dual fuel engine 10 rotates the camshaft 12, via a pulley and belt arrangement (not shown) or by means of a gear and pinion arrangement (not shown), for example. As the cam lobe 22 is attached to the camshaft 12, a consequent rotation of the cam lobe 22 is attained. This rotational movement causes an oscillatory movement of the rocker arm 24 and corresponding opening and closing of the intake valves 16. The cam-profile 28 of the cam lobe 22 enables the intake valves 16 to be in the open position for a range of crank angles that correspond to the intake stroke of the dual fuel engine 10. Before the intake valves 16 is switched to the closed position, the IVA piston 26 is actuated from the retracted position to the extended position. In the extended position, the face portion 40 of the IVA piston 26 abuts and pushes against the pad surface 30 of the rocker arm 24 and restricts an immediate closure of the intake valve 16. This enables the intake valves 16 to be locked in the open position temporarily. Effectively, the intake valves 16 are maintained in the open position for crank angles that correspond to a portion of the compression stroke.

It may be noted that the pad surface 30 of the rocker arm 24 is in the plane, Y that passes through the central axis C-C' of the rocker shaft 14 and the piston axis X-X' is perpendicular to the pad surface 30 of the rocker arm 24. This facilitates a force on the pad surface 30 in a direction perpendicular to the pad surface 30 of the rocker arm 24. Therefore, no reverse side force is applied on the IVA piston 26, which increases life of the IVA system 18.

Moreover, the cam-profile 28 of the cam lobe 22 facilitates a constant velocity of the intake valves 16 at the hand-off of the IVA system 18. This facilitates zero acceleration at the hand-off and therefore no jerk motion is observed on the components of the IVA system 18, such as but not limited to, the intake valves 16, the rocker arm 24 and the IVA piston 26. A jerk less operation of the cam lobe 22 increases life of the IVA system 18.

Furthermore, the IVA system 18 as described in the present disclosure enables the opening and closing of the intake valves 16 for crank angles that correspond to the intake stroke and a portion of the compression stroke of the dual fuel engine 10. However, the present disclosure is explained with the IVA system 18 applied to the dual fuel engine 10, it may be noted that the concepts of the present disclosure may also be applied to a diesel fuel engine. More specifically, the IVA system 18 of the dual fuel engine 10 may be installed on a conventional diesel fuel engine. This may be accomplished by retrofitting the IVA system 18 (the cam lobe 22, the rocker arm 24, and the IVA piston 26) on to a conventional diesel fuel engine. The retrofittable IVA system 18 thereby facilitates the conversion of a conventional diesel engine into a duel fuel engine.

It should be understood that the above description is intended for illustrative purposes only and is not intended to limit the scope of the present disclosure in any way. Those skilled in the art will appreciate that other aspects of the disclosure may be obtained from a study of the drawings, the disclosure, and the appended claim.

What is claimed is:

1. An intake valve actuation (IVA) system for a dual fuel engine, the IVA system being retrofittable between the dual fuel engine and a diesel fuel engine, the dual fuel engine having at least one intake valve, a camshaft, and a rocker shaft, the rocker shaft having a central axis, the IVA system comprising:

a cam lobe including a cam-profile;

a rocker arm having a pad surface, the rocker arm being rotatably mounted on the rocker shaft, wherein the pad surface includes a plane that passes through the central axis of the rocker shaft, the rocker arm being operably connected with the cam lobe and the at least one intake valve, wherein a rotational movement of the cam lobe corresponds to an oscillatory movement of the rocker arm, and which correspondingly facilitates a switch between an open position and a closed position of the at least one intake valve; and an IVA piston having a piston axis and a face portion, the face portion being oppositely arranged relative to the pad surface of the rocker arm, the face portion selectively abuts and pushes against the pad surface, to restrict the oscillatory movement of the rocker arm and at least temporarily lock the at least one intake valve in the open position, wherein the IVA system defines a hand-off when the face portion of the IVA piston abuts against the pad surface of the rocker arm, wherein the cam-profile facilitates a constant velocity of the at least one intake valve at the hand-off of the IVA system.

* * * * *